US006230419B1

(12) United States Patent
Hinter et al.

(10) Patent No.: US 6,230,419 B1
(45) Date of Patent: May 15, 2001

(54) APPARATUS AND METHOD FOR DRYING RELATIVELY SMALL LOTS OF PRODUCTS

(75) Inventors: James L. Hinter, Ankeny; Charles G. McBee, Cumming, both of IA (US)

(73) Assignee: Pioneer Hi-Bred International, Inc., Des Moines, IA (US)

( * ) Notice: Subject to any disclaimer, the term of this patent is extended or adjusted under 35 U.S.C. 154(b) by 0 days.

(21) Appl. No.: 09/498,277

(22) Filed: Feb. 4, 2000

Related U.S. Application Data

(62) Division of application No. 09/390,129, filed on Sep. 3, 1999, now Pat. No. 6,085,443.

(51) Int. Cl.[7] ..... F26B 7/00

(52) U.S. Cl. ..... 34/381; 34/402; 34/486; 34/495

(58) Field of Search ..... 34/380, 381, 385, 34/386, 402, 482, 486, 495; 73/28.03, 28.04, 38

(56) References Cited

U.S. PATENT DOCUMENTS

| | | | | |
|---|---|---|---|---|
| 3,404,467 | * | 10/1968 | Burghard | 34/574 |
| 3,526,969 | * | 9/1970 | Alms et al. | 34/574 |
| 3,629,954 | | 12/1971 | Lavalier . | |
| 4,249,891 | | 2/1981 | Noyes et al. . | |
| 4,312,219 | * | 1/1982 | Lee et al. | 73/76 |
| 4,346,524 | * | 8/1982 | Wochnowski et al. | 34/482 |
| 4,404,756 | | 9/1983 | Noyes . | |
| 4,546,362 | | 10/1985 | Haried . | |
| 4,599,809 | | 7/1986 | Parkes . | |
| 5,299,140 | * | 3/1994 | Ankeny et al. | 73/38 X |
| 5,893,218 | | 4/1999 | Hunter et al. . | |
| 6,045,345 | * | 4/2000 | Eder et al. | 425/4 R |

OTHER PUBLICATIONS

Moisture Determination Methods in Corn, A Thesis Presented to the Faculty of the Graduate School of the University of Minnesota by William B. Ambrose in Partial Fulfillment of the Requirements for the Degree of Master of Science, 1966.

Chart Figure B–1, Resistance of grains and seeds to airflow; From ASAE Standards, Am. Soc. Agric. Eng., St. Joseph, MI, 1988, data from C.K. Shedd, Resistance of grains and seeds to airflow, Agric. Eng. 34: 616–619, 1953.

* cited by examiner

*Primary Examiner*—Stephen Gravini
(74) *Attorney, Agent, or Firm*—Zarley, Mckee, Thomte, Voorhees & Sease

(57) ABSTRACT

An apparatus and method for drying small lots of product, for example ear corn. The method includes simultaneously directing air flow through the product while weighing the product from time to time to derive moisture content to the product. Air temperature and flow can be adjusted to desired levels for controlling the drying process. The apparatus includes an air permeable product bin and a docking station for receiving the bin. A scale is associated with the docking station to obtain weight measurements during the drying process. An air plenum supplies controlled air flow to the docking station. The structure allows monitoring of moisture content during drying and control of air flow. The temperature can also be controlled through control of an air gate from a main hot and cold air plenum.

20 Claims, 11 Drawing Sheets

APPARATUS AND METHOD FOR DRYING RELATIVELY SMALL LOTS OF PRODUCTS

This application is a division of application Ser. No. 09/390,129, filed Sep. 3, 1999, now U.S. Pat. No. 6,085,443.

BACKGROUND OF THE INVENTION

A. Field of the Invention

The present invention relates to dryers and methods of drying, and in particular, dryers and methods of drying relatively small lots of product.

B. Problems in the Art

There are a number of situations that utilize forced air drying techniques. Many are large-scale drying systems concerned with processing large volumes of product per unit of time. There are other situations that require air drying of what would be called small lots of product. Drying smaller lots would not require the scale of equipment necessary for large lots. In fact, the use of large lot equipment for drying small lots would many times be inefficient.

An example of small lot drying is the drying of ear corn for seed conditioning purposes. Ear corn in lots of up to about 50 bushels is harvested and dried for maximum quality of seed for replanting.

The term "small lot" with regard to seed corn is defined herein as up to several tens of bushels, for example, up to around 50 bushels. It is difficult to justify utilizing dryers for large lots (e.g. well over 50 bushels) to dry small lots because of their cost, complexity, size, and operation. Seed corn must be dried right or its value might be lost. It can be extremely valuable (on the order of thousands of dollars per bushel). It is usually harvested as soon as possible to avoid degradation by insects, disease or weather. However, such early harvesting generally means that the moisture content of the corn is relatively high (e.g. 40%).

To maintain the quality of the seed, it is desirable to dry to seed corn immediately after harvesting. If it were not dried, it would be especially susceptible to degradation by, for example, molds or fungi. However, the drying process must occur correctly or the seed corn may be damaged.

Generally, it is preferred to dry by taking away a certain percent of moisture over each time period. For example, one guide is to take away 1% of moisture every 4 hours. Thus, a bin of seed corn at 40% harvested moisture could take 112 hours, or almost 5 days to dry. Therefore, there is a need in the art to dry the corn at as close to the ideal rate as possible. If heated air is used that is too hot, it could damage or even kill the seed. If drying is too slow, the seed become susceptible to mold or fungi. Furthermore, slow drying is not optimal use of time and resources.

A further complication is that each collection of seed to be dried will not have identical drying needs. Therefore, there is a need in the art for the ability to adjust drying to individual needs of each lot being dried. Conventional small lot dryers provide a source of heated air flow. However, the temperature of the air is not adjustable on a bin to bin basis, but is constant for all bins sharing a plenum.

U.S. Pat. No. 5,893,218 describes a dryer that holds larger lots (e.g. from about 50 to 1,000 bushels). The contents of that patent are incorporated by reference in their entirety herein. The dryer disclosed in U.S. Pat. No. 5,893,218 allows flexible control of air temperature by providing hot and cold air plenums with controllable gates to mix air to desired temperature. Air flow direction can also be reversed and a rate of air flow can be adjusted.

Although this system provides highly flexible control of air temperature, there is still a need for improvement in such a drying process.

Drying of small lots of ear corn is not a matter of how to most quickly dry the ear corn. Rather it is the quality of drying that is important. By this it is meant that optimally, drying should proceed at a certain rate; or stated differently, quality of the dried seed is related to the rate of moisture removal during drying. This depends on the nature and type of material and its initial moisture content. Presently, manually collected moisture samples are taken during the drying process to check on drying rate. The rate of the air flow is normally adjusted based on those samples. This is time consuming and cumbersome. Therefore, there is room for improvement in the art.

It is thus a primary object of the present invention to provide an apparatus and method for drying of small lots of product which overcomes or improves over the problems and deficiencies in the art. Further objects, features, and advantages of the present invention include a method and apparatus as above-described which:

1. Allows automation of the drying process.

2. Provides a higher degree of flexibility and selectability of variables during drying.

3. Allows precise control of rate and temperature of air flow while allowing automated monitoring of moisture in the product.

4. Allows individual control of drying of multiple small lots.

5. Maximizes the quality of drying of the product and therefore the quality of the product.

6. Allows for automatic acquisition of drying process data for use in quality assurance documentation and decisions.

7. Provides for an improved level of process control for drying.

8. Improves the efficiency of time and resources utilized in drying.

9. Is efficient, economical, and durable.

These and other objects, features, and advantages of the present invention will become more apparent with reference to the accompanying specification and claims.

SUMMARY OF THE INVENTION

The invention includes apparatus and method for drying of small lots of this product. The method includes directing air flow through a small lot of product, weighing the product at discrete times, and setting temperature and rate of air flow based on such weighing. Optionally, the method includes converting the weighings to moisture content of the product and controlling temperature and rate of air flow based on such conversions.

The apparatus includes an air permeable product bin, a docking station having a receiver for the bin, an air inlet and an air path between the inlet and the receiver, a weighing device to weigh the product in the bin placed on the receiver, and an air plenum through which an air flow of controllable temperature and rate can be communicated to the docking station and through the product in the air permeable bin.

The system according to the invention could include a programmable logic controller and/or portable or personal computer and temperature and pressure sensors. Data from the temperature and pressure sensors, as well as the weighing device, would allow the controller or PC to calculate the level of moisture in the product and to control components that would adjust air temperature and rate of air flow to adjust the drying of the product.

DETAILED DESCRIPTION OF THE PREFERRED EMBODIMENT

Figure 1:
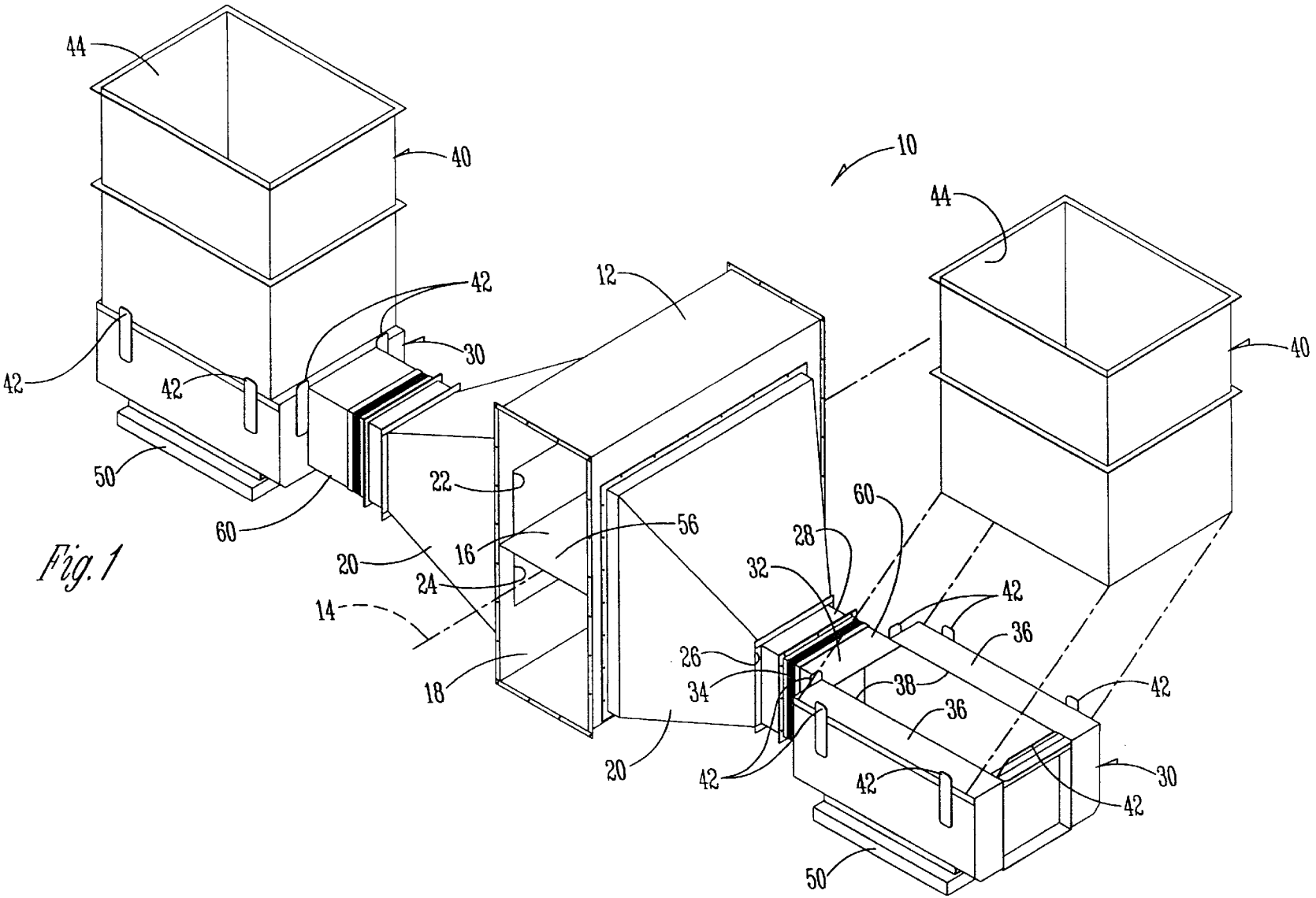
FIG. 1 is a partial perspective view of a section or segment of an apparatus according to the preferred embodiment of the invention with one seed box shown removed.

To gain a better understanding of the invention, one embodiment will now be described in detail. Frequent reference will be taken to the drawings in this description. Reference numerals and letters will be used to indicate certain parts and locations in the drawings. The same reference numerals and letters will be used to indicate the same parts and locations throughout the drawings unless otherwise indicated.

This embodiment will be described in relation to the drying of ear corn in up to approximately 50 bushel lots. It is to be understood that the invention has applicability beyond this embodiment and this product.

A dryer 10 according to the preferred embodiment of the present invention is shown in FIG. 1. A main air plenum assembly 12 extends along an axis 14. A segment only of main air plenum assembly 12 is shown in FIG. 1. Main air plenum assembly 12 is internally divided into a warmer air plenum 16 and a cooler air plenum 18 as will be described in more detail later. A mixing chamber or plenum 20 is attachable along main air plenum assembly 12. As can be seen in FIG. 1, mixing chambers 20 can be installed on opposite sides of main air plenum assembly 12 to provide adjustable drying air for two lots of ear corn. The structure associated with mixing chambers 20, as well as the additional structure on opposite sides of main air plenum assembly 12, is identical. Therefore, the structure associated with one side only will be described for brevity.

As can be seen in FIG. 1, each side wall of main air plenum assembly 12 contains an opening 22 and an opening 24, each associated with warm air plenum 16 and cool air plenum 18 respectively. Mixing chamber 20 is connected to and encloses openings 22 and 24 and is transitioned or funneled down to an outlet opening 26.

An air flow control louver assembly 28 (see FIG. 2) is mounted at outlet opening 26. A docking station/plenum 30 is connected to flow control louver assembly 28. Docking station 30 is in fluid communication with mixing chamber 20 via air louver assembly 28, flexible coupling 34, and inlet tube 32. Docking station 30 is basically an airtight box having top mounting surfaces 36 that define an air outlet 38. A portable bin 40 is removably positionable on top mounting surfaces 36 of docking station 30 and is retained against lateral movement by tabs 42 distributed around the perimeter of docking station 30. These tabs also aid in properly positioning bin 40 on surface 36 when it is lowered into such position.

Figure 13:
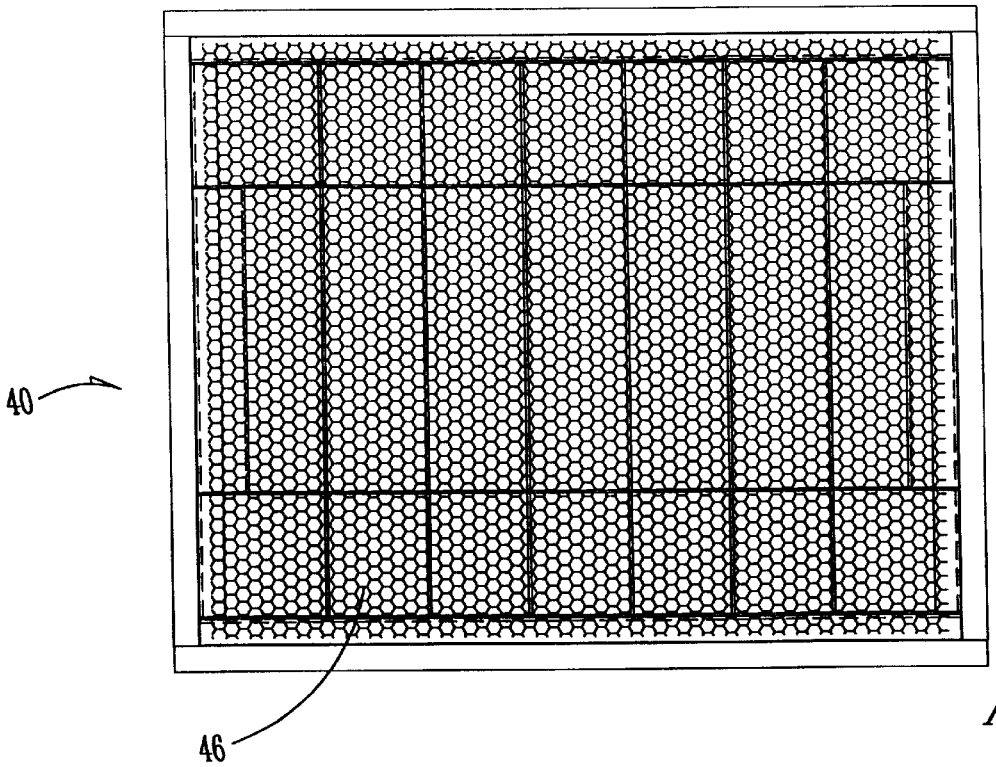
FIG. 13 is a top view of the seed bin of FIG. 1.
Figure 14:
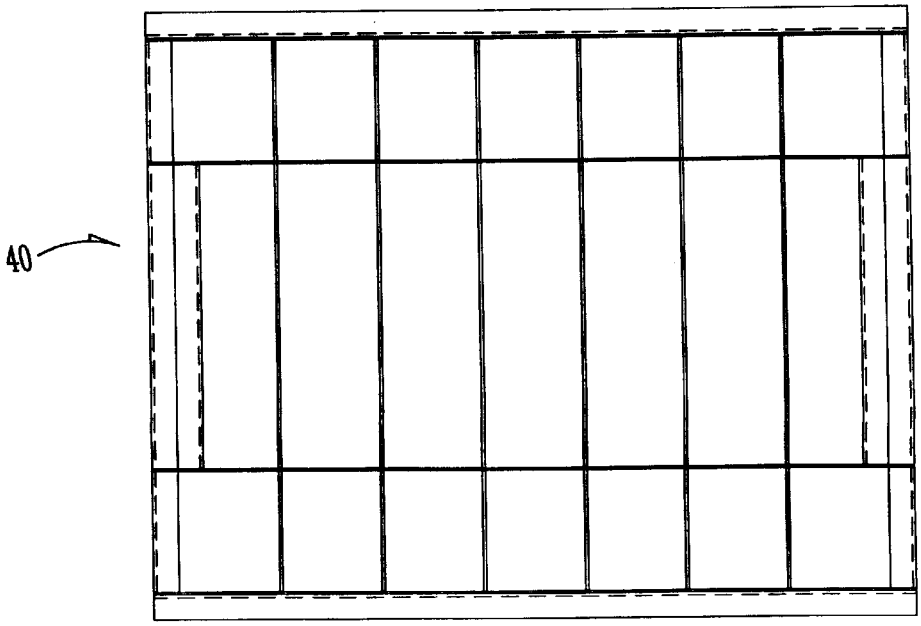
FIG. 14 is a sectional view taken along lines 14—14 of FIG. 11 with the perforated floor removed.

As will be described in more detail later, bin 40 has an open top 44 and an air permeable bottom 46 (see FIG. 13). The side walls of bin 40 are not air permeable. Air can freely flow through bottom 46 and out the top 44.

As shown in FIG. 1, the apparatus of dryer 10 allows a mixing of hot and cold air from plenum sections 16 and 18 in mixing chamber 20. The terms "hot" and "cold" are relative to one another. In other words, air in plenum 16 is warmer that air in plenum 18. The mixing of hot and cold air in mixing chamber 20 can be accomplished by using one or more mechanically controlled slide gates 70 (see FIG. 3). Slide gate or gates 70 can block completely either opening 22 to warm air plenum 16 or opening 24 to cold air plenum 18 or can partially unblock both openings 22 and 24 in varying proportions. This is similar to the warm and cool air mixing possible with the plenums and gates disclosed in U.S. Pat. No. 5,893,218. Other apparatus and methods can be used. Control of that mixed air into the interior of docking station plenum 30 is accomplished through air flow control louvers 28 and flexible coupling 34. The air flow, of controlled temperature and rate, is then directed through air permeable bottom 46 of bin 40 (when placed on docking station 30—see left side of FIG. 1), through any product (e.g. ear corn) in bin 40, and out the top 44. Each docking station 30 is placed on a 48" by 48" platform scale 50 (e.g. Cardinal Scale Model FHN 445). Alternative weighing devices can be used. Examples are load cells and strain gauges. Weight measurements can be periodically taken. Prior knowledge of the weight and initial moisture content of bins 40 allows the moisture of product in bin 40 to be determined from its weight during the drying process.

Figure 2:
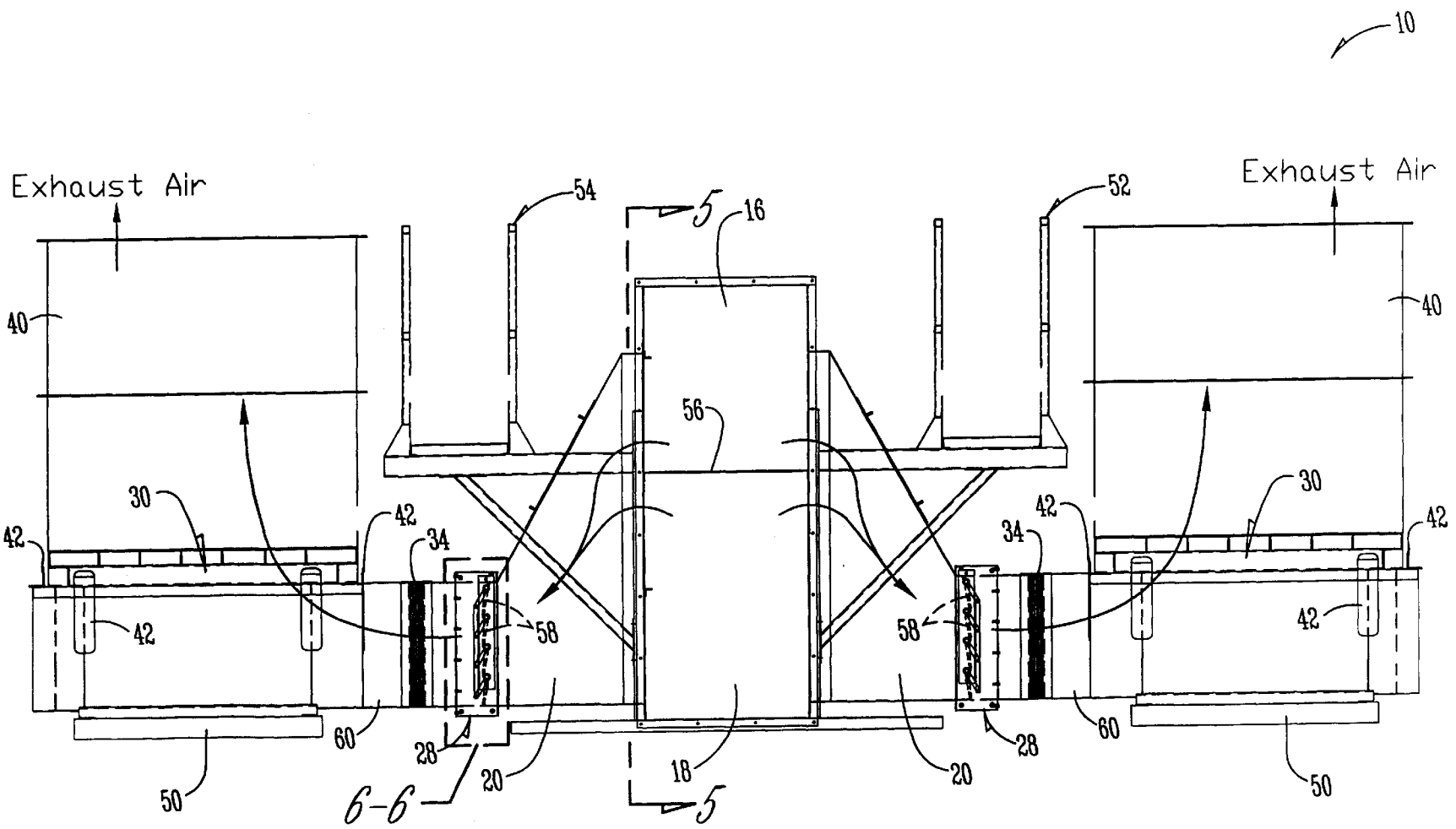
FIG. 2 is an elevational sectional view of FIG. 1 additionally showing worker platforms.

FIG. 2 illustrates via arrows the general air flow through dryer 10 for each bin 40. FIG. 2 also shows the optional platforms 52 and 54 for workers to walk and remove samples from bin 40 or otherwise view or marshal the drying process.

Bins 40 can vary in size and construction. They can be approximately 60 inches wide by 48 inches deep by 67⅛ inches tall. With these dimensions, they can hold between approximately 5 and 30 bushels of ear corn, and can include flooring structure that accommodates the air permeable floor 46 and other structural supports for such a load.

Plenum assembly 12 can be approximately 32 inches inside width by 84 inches tall. A dividing wall 56 can be positioned approximately 48 inches from the bottom of plenum assembly 12 thus dividing the vertical height of plenum assembly 12 into a 48 inch cooler air plenum 18 and a 36 inch warmer air plenum 16.

Openings 22 and 24 can be on the order of 18 inches tall by 65 inches wide. An electrically powered actuator operates slide gate 70 such as described in U.S. Pat. No. 5,893,218, incorporated by reference herein, to allow air from warm air plenum 16 and cold air plenum 18, in desired proportions, into mixing chamber 20. Mixing chamber 20 is essentially an air transition and mixing component. It can be 68 inches overall in height by approximately 30 inches deep with a back wall (connected to plenum assembly 12) of approximately 70 inches wide by 68 inches tall. The housing of mixing chamber 20 narrows down to outlet opening 26 which is essentially 24 inches square and has its bottom-most edge co-planar with the bottom-edge of mixing chamber 20.

Figure 8:
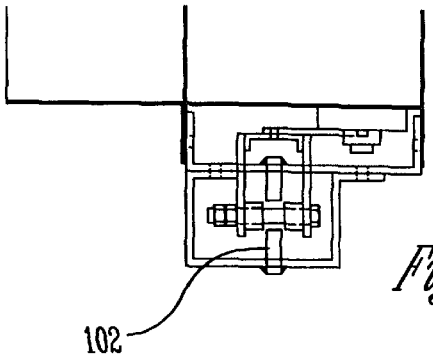
FIG. 8 is a partial top sectional view of FIG. 7.

Air flow control louver assembly 28 (see, e.g., FIGS. 6–8) can consist of multiple louvers 58 connected to a common linkage 100 (FIG. 7) that can be opened and closed over a range by an electrically controlled actuator. Flexible coupling 34 can be a Duradyne flexible duct, in accordion shape, that allows an air impermeable channel from mixing chamber 20 into docking station 30, but avoids a rigid connection therebetween so that there will not be any effect on weighing of the contents of bins 40 by that coupling.

Docking station 30 (see, e.g., FIG. 9) can include a 24×24 inch-in-cross-section connection to flexible coupling 34 and generally a 64 inch wide by 25¾ inch tall by 44 inch deep housing. Air outlet 38 is approximately 24 inches by 56 inches. Therefore the bottom of bin 40 fits onto top supporting surfaces 36 but is still presented with a substantial opening 38 through which air can move through permeable bottom 46 of bin 40 and through the product in bin 40.

Figure 3:
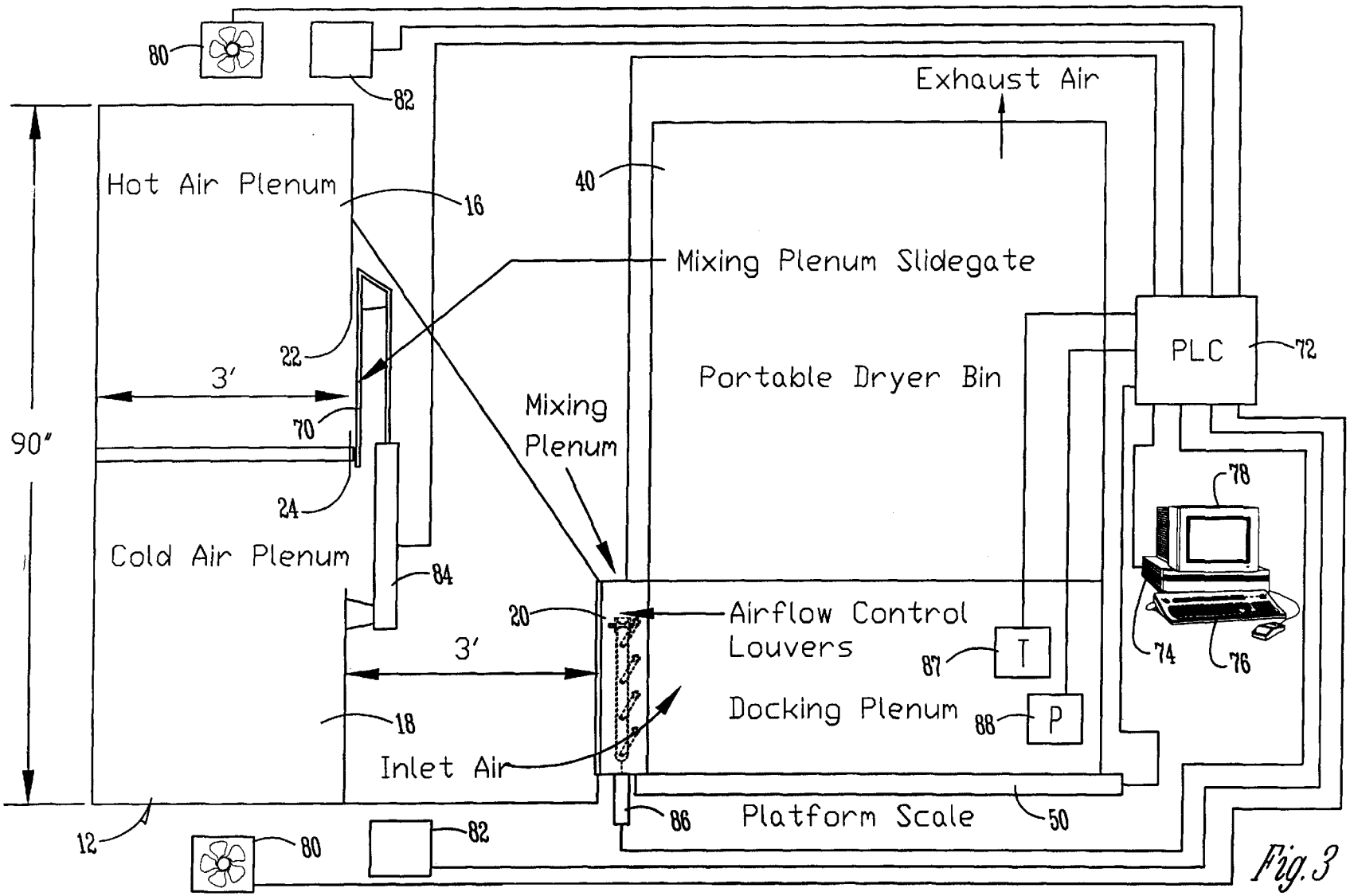
FIG. 3 is a diagrammatical view of one side of FIG. 2, additionally showing connection to a digital controller and various sensors and actuators.

FIG. 3 illustrates diagrammatically the operation of dryer 10. Slide gate 70 is movable to completely block opening 22 or opening 24 from plenum assembly 12 or, in intermediate positions, allow air from each of plenum 16 and 18 into mixing plenum 20 in various proportions based on the position of slide gate 70. This is described in detail in U.S. Pat. No. 5,893,218. A programmable logic controller 72 can be electrically connected to a PC 74 having an input mechanism 76 (e.g. keyboard) and a display 78. Programmable logic controller 72 can be connected to variable frequency drive equipped, independently controlled blowers 80 which create pressurized air through hot and cold plenums 16 and 18 respectively, and independently controllable heaters 82 which can heat the air in plenums 16 and 18. It can also be connected to actuator 84 for slide gate 70 and actuator 86 for air flow control louvers 58, and to a thermocouple 87 and pressure sensor 88 positioned in docking plenum 30. As can be seen in FIG. 3, the control circuitry therefore can obtain data regarding current air temperature and air flow in docking plenum 30, as well as input from the platform scale 50. This information allows computer 44 to keep track of and store the drying process parameters on a real time and automated basis.

It is known that there is a relationship between weight of a product and its moisture content.

It can be emperically derived by one of skill in the art. The general protocol is set forth below:

Monitoring Seed Drying by Weighing a Drying Bin

1. Determine the weight of the ear corn.
2. Remove and weigh a subsample of the ear corn.
3. Separate the subsample into seed and cob fractions.
4. Weigh each fraction and dry in an oven for 24 to 72 hours at 103 degrees Celsius.
5. Re-weigh each fraction.
6. Calculate the percentage moisture in ear corn that is contained in the seed by the following calculation:

Weight of seed fresh=$Sdwt_f$

Weight of seed dry=$Sdwt_d$

Weight of cob fresh=$Cbwt_f$

Weight of cob dry=$Cbwt_d$ $(Sdwt_f+Cbwt_f)-(Swdt_d+Cbwt_d)$=weight of water in ear corn sample $Sdwt_f-Sdwt_d$=weight of water in seed Weight fraction of water in seed=$((Sdwt_f-Sdwt_d)/(Sdwt_f+Cbwt_f)-(Sdwt_d+Sdwt_d))$ 7. Take the weight of the ear corn and calculate the total amount of water it contains:

Weight of water=Ear of corn weight×$(1-((Sdwt_d+Cbwt_d)/(Sdwt_f+Cbwt_f)-(Sdwt_d+Cbwt_d)))$ 8. The weight of water in the seed can be calculated by multiplying the total weight of water in the ear corn by the weight fraction of water in seed.

Weight of water×weight fraction of water in seed =weight of water in seed

9. As the weight of the bin changes due to drying (removal of water), the loss of water can be partitioned between a loss of water from the cob and a loss from the seed. Since the dry weight of the seed is known, the seed moisture can be recalculated at any time.

Earcorn weight(initial)−earcorn weight(current)=weight of water removed by drying (Weight of water removed by drying)×(weight fraction of water in seed)=weight of water removed from seed.

$Sdwt_f$(initial)−weight of water removed from seed=$Sdwt_f$(current)

10. The current seed moisture can then be calculated simply by:

$[((Sdwt_f(current))-(Sdwt_d))/(Sdwt_f(current)]\times 100=$ % seed moisture

For example if the current weight of the seed is 100 pounds and the dry weight of the seed is 80 pounds the percent seed moisture, on a fresh weight basis is 20%.

$((100-80)\times 100=20\%$

This process of re-estimating moisture can occur continuously. It may be necessary to periodically check the weight fraction of water in seed to make sure that it is valid for the particular genotype, this sample of genotype and at the current moisture.

Therefore knowledge of weight of the ear corn at discrete times, as well as temperature and air flow, allows PC 74 to display graphically to the operator current and historical moisture data for each bin. The operator then may use system software to instruct the system to automatically attain and maintain certain air temperature, and to move flow control louvers 58 to achieve certain air flow rate to maximize drying quality for ear corn in bin 40.

Figure 4:
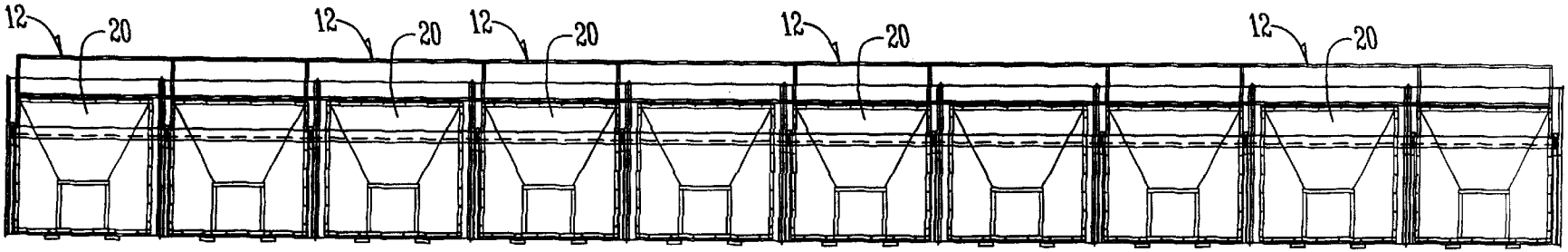
FIG. 4 is an elevational view of a plurality of side by side sections similar to that shown at FIG. 1.

FIG. 4 illustrates by side elevational view that a single main air plenum assembly 12 could service a plurality of individual mixing chambers 20 (on either side of plenum assembly 12), which could in turn service a plurality of individual docking stations 30 (not shown, but see FIG. 1). Each mixing chamber 20 and docking station 30 could have individually controllable air gates 70, louvers 58, and other components so that drying of the contents of each bin 40 could be individually adjusted and customized. PC 74 can keep track of from one to a large number of bins 40 and would allow automation of the drying process for each bin 40 even if several tens of bins were serviced by the same main air plenum assembly 12.

Figure 5:
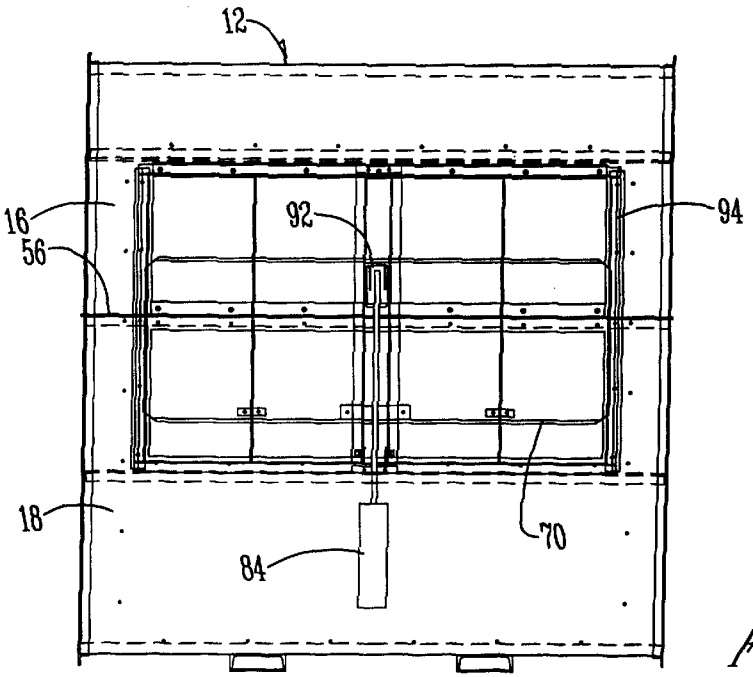
FIG. 5 is an enlarged isolated sectional view of the interior of the device of FIG. 1, in particular illustrating a slide gate between hot and cold plenums and a mixing chamber plenum.

FIG. 5 illustrates in more detail slide door gate 70. Actuator 84 (e.g. Warner ElectroTrac Series 1000#CAP (24 VDC) 24 inch stroke model with internal end limit switches) has a 24 inch throw connected to a mounting bracket 92 of slide gate 70. A frame 94 captures slide gate 70 and allows it to be moved between top and bottom positions. In a top position it completely covers air inlet opening 22 and completely uncovers air inlet 24. In its lower-most position, it is the reverse. In intermediate positions, it allows some air from both plenums 16 and 18 to enter mixing chamber 20.

Figure 6:
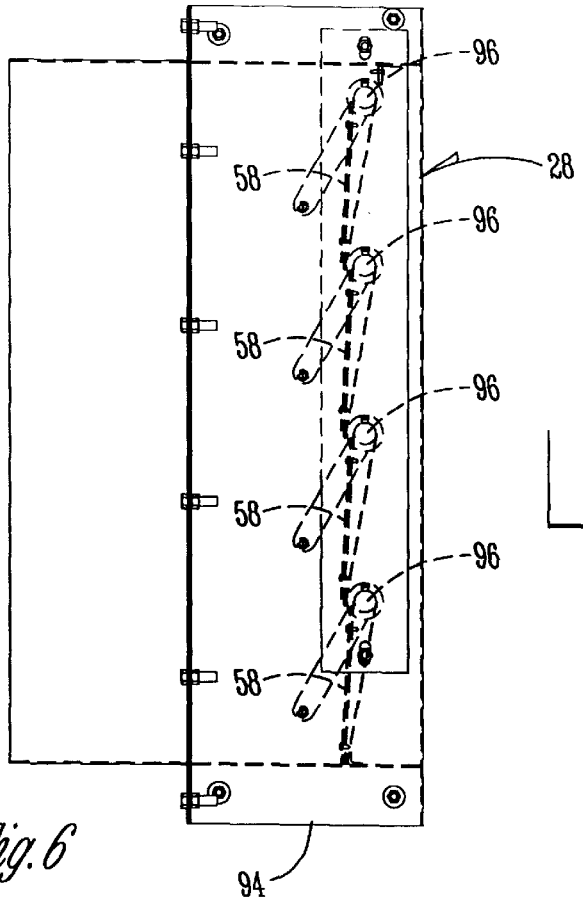
FIG. 6 is an enlarged side elevational view of air control louvers positioned between the mixing plenum and a docking plenum.
Figure 7:
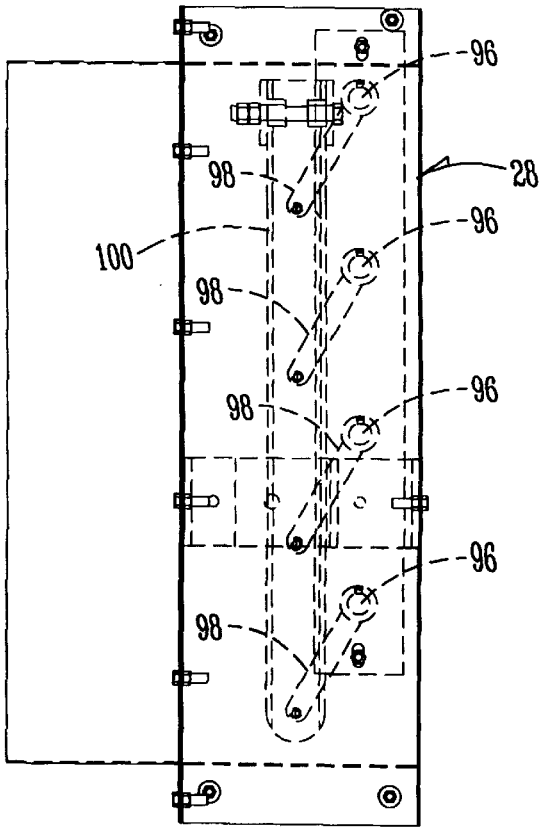
FIG. 7 is a slightly different side elevational view of FIG. 6.

FIG. 6 shows louvers 58 in a closed position in frame 94. By referring to FIGS. 6–8, it can be seen that each louver 58 (23⅝"×5¾"×16 Ga. metal sheet) is attached to an axle shaft 96 that is rotatably mounted in frame 94. Arms 98 are originally mounted at one end to shaft 96 and at another end to bar 100 (FIG. 7). The upper end of bar 100 is in turn connected to a connection 102 (FIG. 8) that is connectable to actuator 86 (Warner ElectroTrac Series 1000#CAP (24 VDC) 12 inch to 24 inch stroke models).

Figure 9:
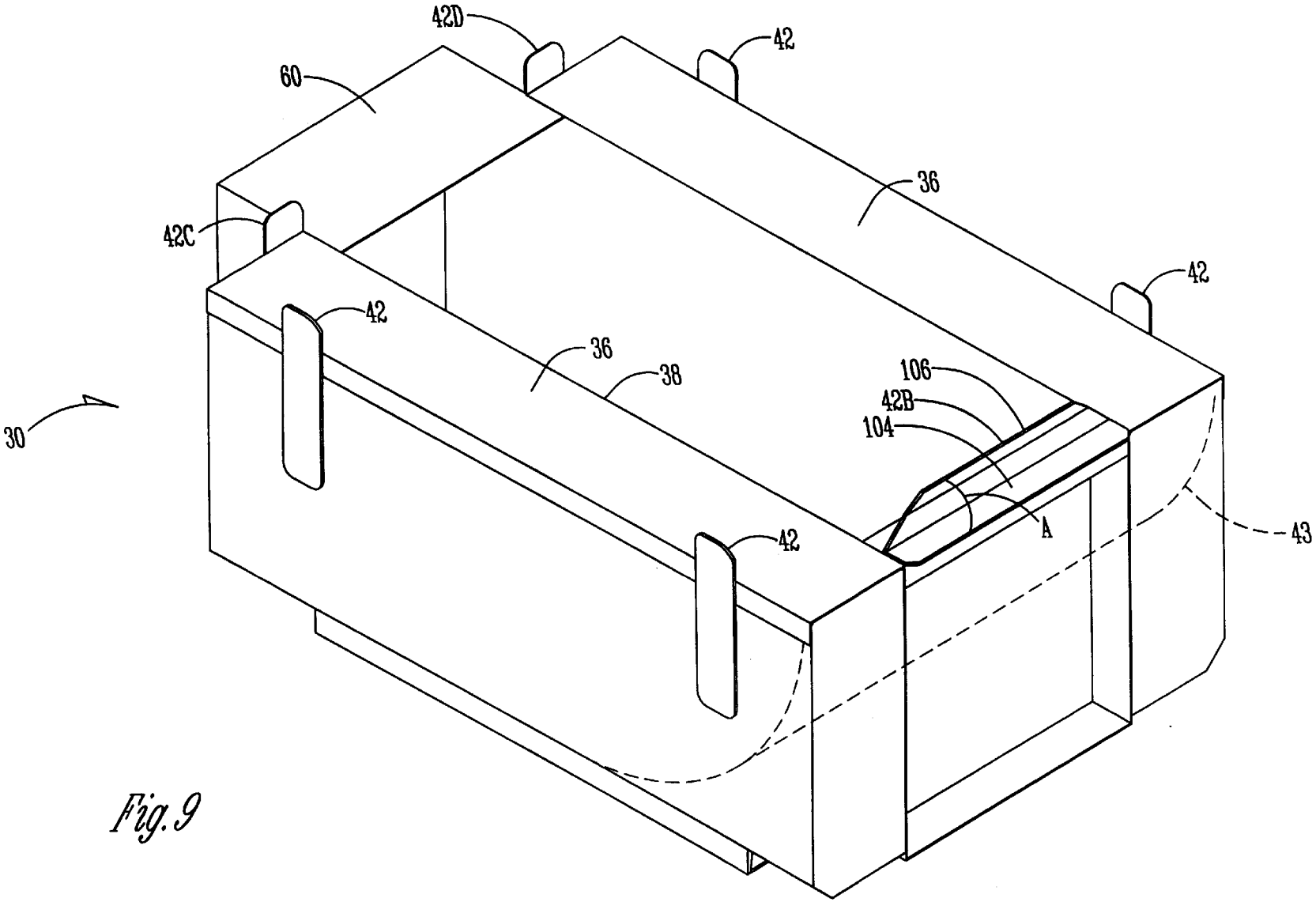
FIG. 9 is an isolated perspective view of a docking station plenum of FIG. 1.
Figure 10:
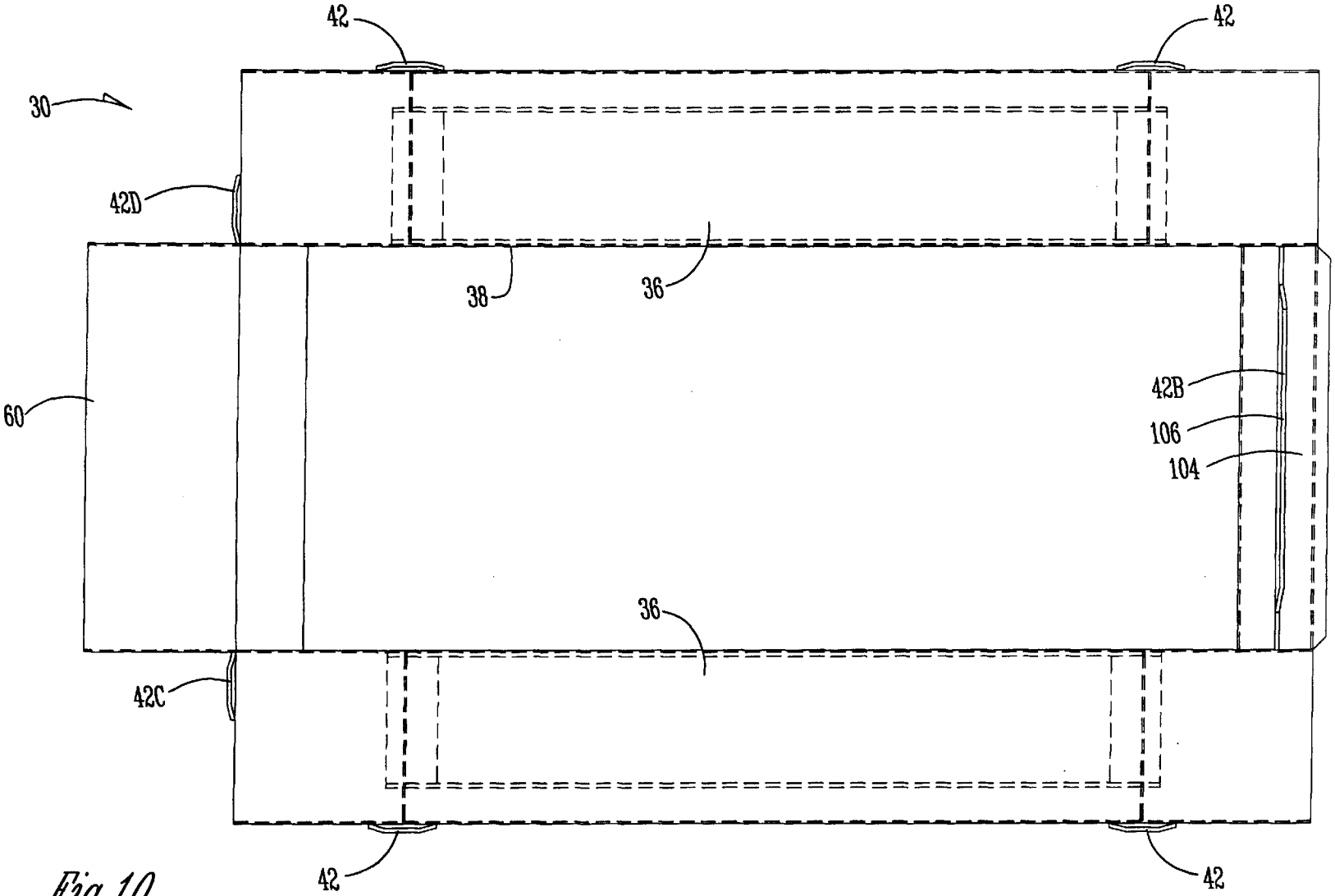
FIG. 10 is a top plan view of FIG. 9.
Figure 11:
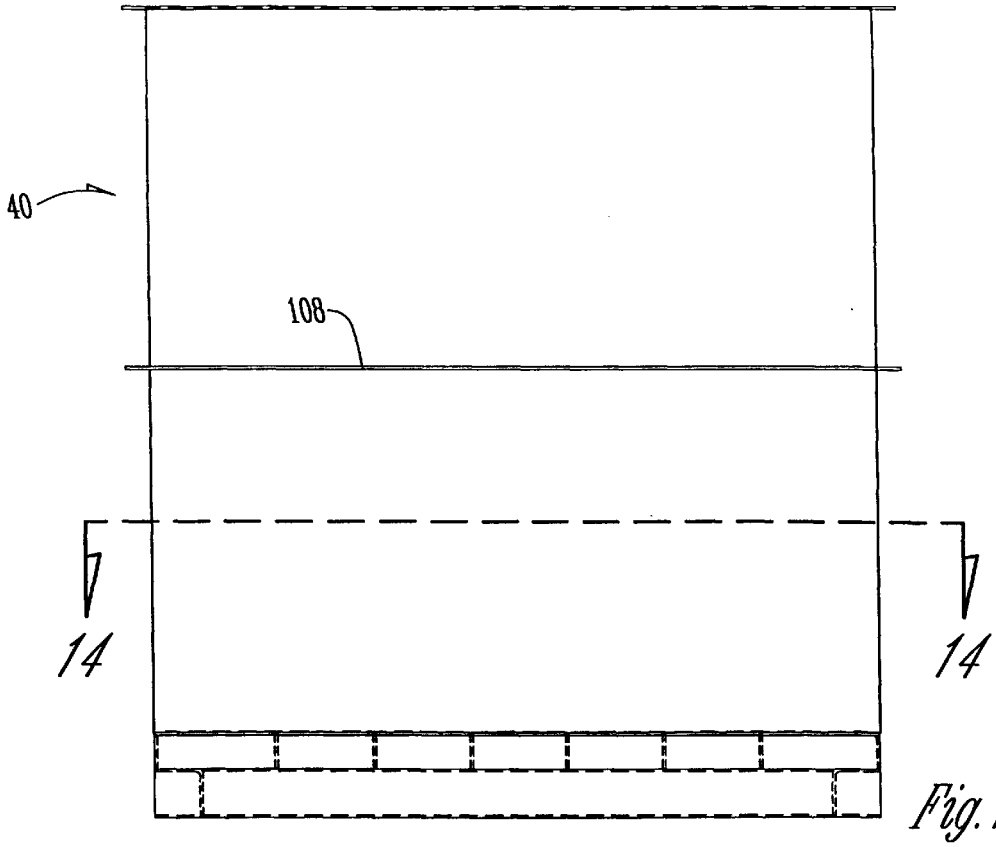
FIG. 11 is a side elevational view of a portable seed bin of FIG. 1.
Figure 12:
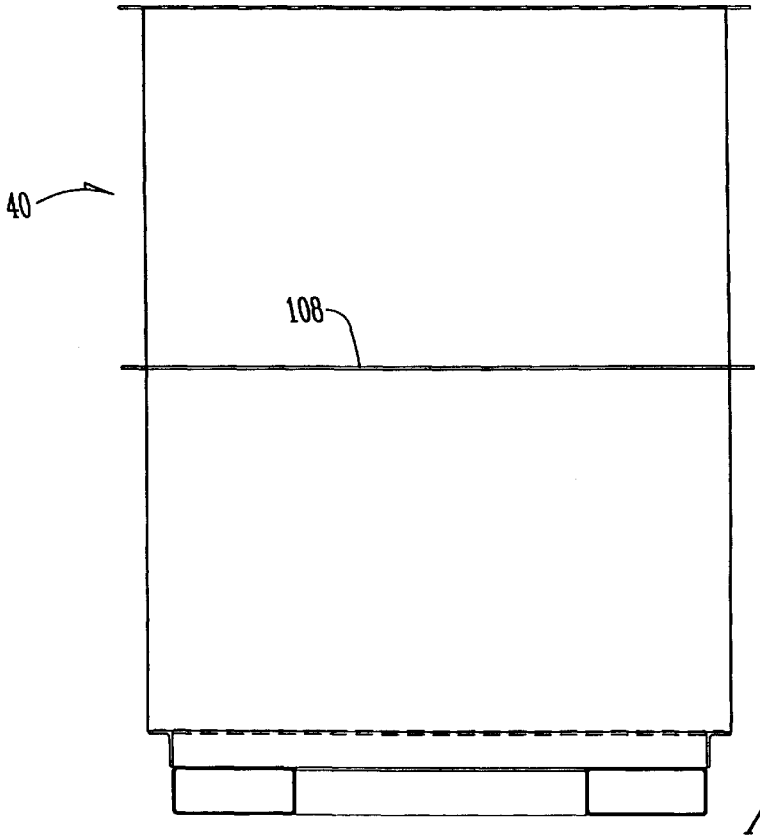
FIG. 12 is an elevational end view of the seed bin of FIG. 1.

FIGS. 9 and 10 illustrate in more detail the structure of docking station 30. Tab 42B has a base 104 and an outwardly extending part 106. An acute angle A is formed between the planes of base 104 and extending portion 106. This assists a fork lift or other mode of force to lift the bin 40 up and over docking station 30 from the direction of tab 42B, lower the far end of bin 40 against tabs 42C and 42D and then lower the closest end past extended portion 106 so that it seats down on supporting surfaces 36. Tabs 42 can be bent outward slightly to help facilitate the docking of bin 40 into docking station 30. Also a curved interior end wall 43 can be used inside docking station 30 to reduce sharp corners for the air flow and thus reduce energy loss.

FIGS. 11–14 illustrate bin 40 in more detail. A middle brace 108 can be constructed on the exterior of bin 40 (e.g. side beam ¼ by 2 inch fb by 64⅛ inch long in longest dimension and ¼ by 2 inch fb by 48⅛ inch long in the shortest side). This would provide structural strength for the box and handling by a fork lift.

The bottom of bin 40 can be constructed of cross members for strength but spaced apart to allow easy air flow through the bottom of bin 40. Air permeable floor 46 can be made of 47 inch by 58 inch by 16 ga. perforated bin flooring with 3/16 on center holes on ¼ inch staggered centers.

Figure 15:
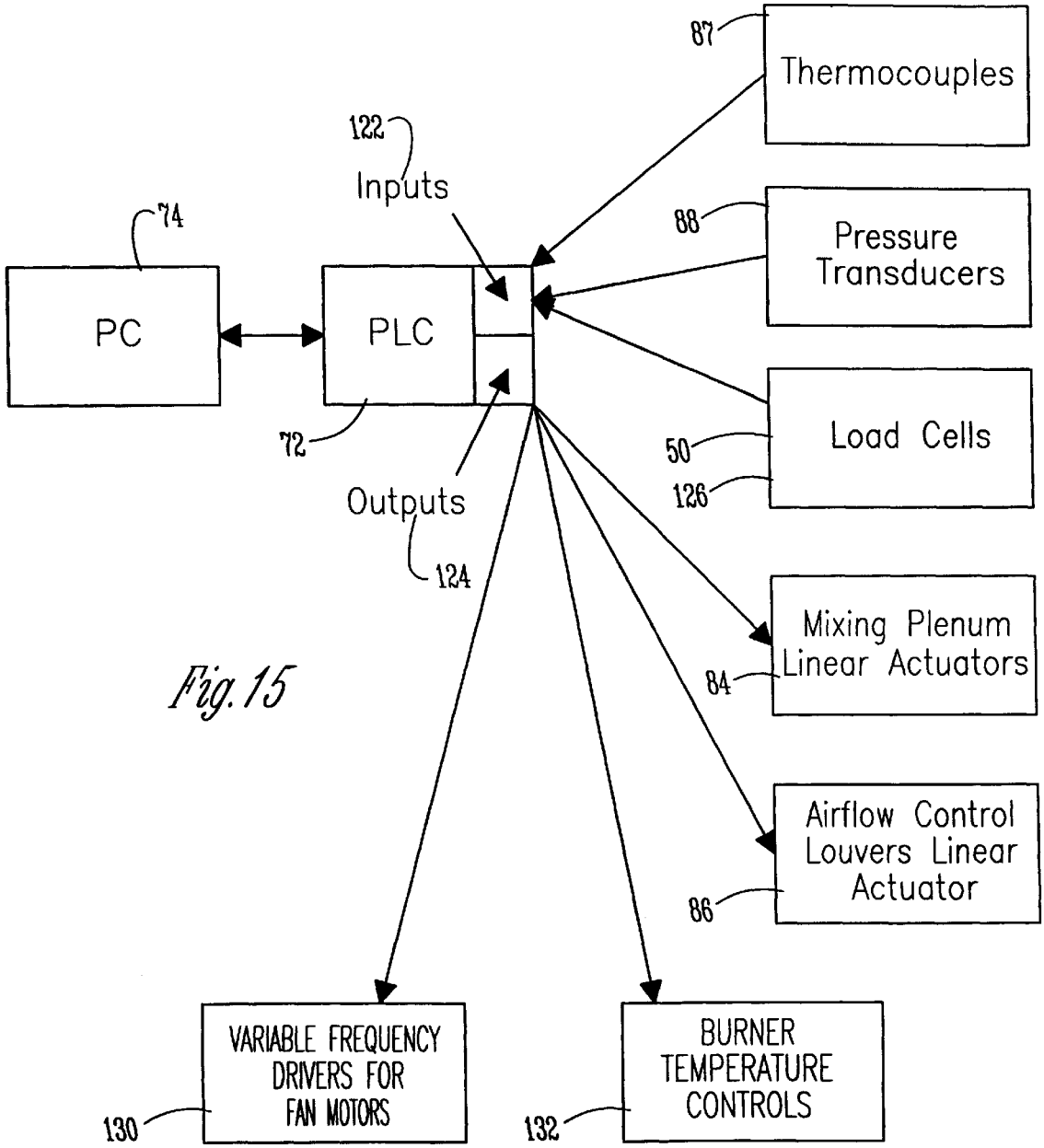
FIG. 15 is a diagrammatic view of electronic circuitry according to a preferred embodiment of the invention.

FIG. 15 illustrates diagrammatically the electrical circuit utilized with the preferred embodiment. As discussed previously with regard to FIG. 3, PLC 72 would operate according to instructions from PC 74 and/or from instructions preprogrammed into PLC 72. PLC 72 also would provide PC 74 with data collection. The information to and from PLC 72 is made possible by using PLC inputs 122 and outputs 124, such as is well known in the art. Thermocouple (s) 87, pressure transducer(s) 88, and load cell(s) 126 (associated with platform scale(s) 50), would transduce temperature, pressure, and weight respectively and send that data in digital form to inputs 122 of PLC 72.

The thermocouple(s) 87 and pressure transducer(s) 88 preferably should be placed as close as possible to the bottom of bin 40 when in place on docking station 30, or in other words, as close to the product in bin 40 as possible, to give the best readings regarding air temperature and air pressure.

Note also the circuit could include a burner control device 132 that would adjust heat to plenums 16 or 18 by adjusting a gas valve to heaters 82 via instruction for PLC 72. The burner controller, well known and commercially available, controls an electric motor that adjusts the amount of fuel to a burner and thus adjusts the heat output of the burner. Likewise variable frequency controls 130 for fans 80 allow PLC 72 to control and equalize pressure in plenums 16 and 18 for better mixing of air.

On the other hand, mixing plenum linear actuator(s) 84 and air flow control louvers linear actuator(s) 86 would be operated by PLC 72 by closing of contractors that could supply operating voltage to the actuator(s) via outputs 124.

By this arrangement, PC 74 can keep track of and store in real time the air temperature, air pressure, and weight and/or moisture content of the ear corn during drying and provide that information to the operator to help the operator select the proper temperature and rate of air flow through the ear corn during drying. Thus, dryer 10 provides moisture monitoring to allow the system to be intelligently used to dry this product. It is to be understood that the way in which different products are dried depends on a number of factors, including initial moisture content, characteristic and type of material, and the needed drying rate.

Figure 16:
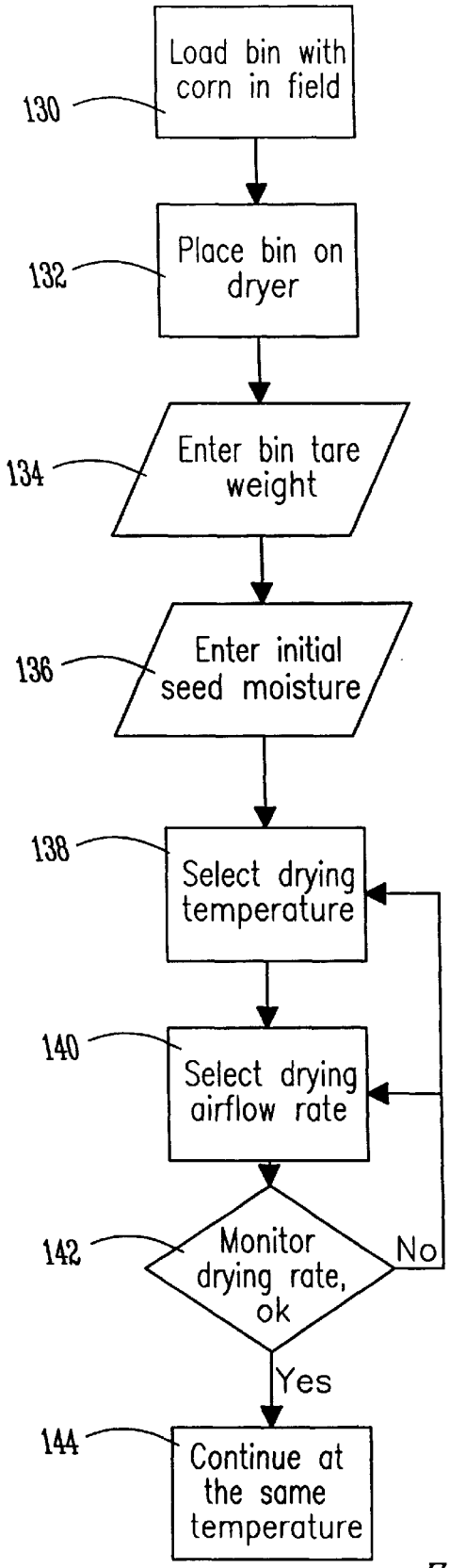
FIG. 16 is a flow chart of software used with the preferred embodiment.

FIG. 16 shows a flow chart of programming for PC 74 and PLC 72 according to the present invention. The programming could be in Ladder Logic and PLC 72 could be Allen-Bradley Model 5/40C.

As shown at FIG. 16, the step 130 comprises loading a bin 40 with corn in the field. Bin 40 would then be transported to and placed upon docking station 30. (See 132). Bin weight (134) and initial moisture (136) would then be entered into computer 74. The drying temperature (138) would be applied by following drying rules set forth below. The same is true for air flow rate (140). Temperature and rate would be controlled adjusting the slide gate 70 and air flow control louvers 58, as previously described.

What will be called the "drying rules" applied at steps 138, 140 and 142 are as follows:

If drying rate is too fast and temperature is equal to ambient temperature, reduce airflow rate.

If drying rate is too fast and temperature is greater than ambient, reduce drying air temperature.

If drying rate is too slow and airflow is equal to normal, then increase drying air temperature.

Monitoring would be continuous (142). If drying rate is deemed within range, it would continue at given settings of temperature and air flow rate. If not, the drying rules would be applied and temperature and/or air flow rate adjusted.

Therefore, as can be seen, the preferred embodiment includes three major components: mechanical components, PC software, and PC 70/PLC 72.

PC 70 runs software that acquires operational data from PLC 72 and run a graphical user interface used to both communicate the operational status of the dryer and of each bin to the operator and to serve as means of prompting the operator for necessary operational information.

The data acquired from PLC 72 by the PC 70 is: Temperature for each bin, plenum, and burner; static pressure for each bin and plenum; and bin weights from each platform scale.

The data acquired from the operator is: Bin contents (description of what is in each bin); initial moisture content for material in each bin; tare weight for each bin; bin ID# at each port; setpoint temperature for each burner; time when drying began for a bin; time when drying finished for a bin; drying temperature for each port (controls the temperature of the air supplied to each bin); drying pressure for each port (dictates airflow rate for each bin).

The data both acquired from the PLC or entered by the operator is all stored in a database to support analysis for quality assurance functions.

The PLC performs the major data acquisition and control functions for the system. The inputs are:

PLC Inputs

Temperature—millivolt inputs from the type-T thermocouples which are converted into digital signals by thermocouple input modules (Allen-Bradley model 1794IRT8).

Pressure—measured by pressure transducers (Setra model 264) that produce a 0 to 5 Volt DC signal proportional to the pressure. The transducer measures from 0 to 5 inches of static pressure so the conversion is based on 1 volt=1" pressure. This signal is acquired by the PLC using an analog input module (Allen-Bradley model 1794IE8).

Bin Weight—the weight is acquired from each Cardinal brand platform scale (model FHN 445) with a 5000 pound capacity as a millivolt signal sent to a Cardinal Programmable Weight Indicator (model 778). This weight indicator has a Remote I/O communications card that allows it to communicate with the PLC using Allen-Bradley's Remote I/O protocol.

PLC Outputs

Burner temperature—the PLC sends the temperature setpoints to each burner temperature controller as a analog signal using an analog output module (Allen-Bradley 1794OE4).

Fan Speed—the speed of each fan is controlled by the PLC sending out an analog signal using an analog output module (Allen-Bradley 1794OE4). The module outputs a 0 to 10 Volt DC signal where output voltage is proportional to fan speed.

Linear Actuators—the movement of the actuators is controlled by the PLC sending a signal to two contractors. One contractor supplies power for extending the actuator and the other supplies power for retracting the actuator. Because of internal limit switches in the actuators (Warner model Electrotrak 100) the power is automatically switched off for extension when fully extended or fully retracted to prevent damage to the actuator motor.

All communications between nodes on the PLC network and between the PLC processor uses Allen-Bradley's ControlNet protocol.

It is to be understood that during the drying, temperature and air flow rate could be varied while maintaining a given drying rate. In other words, the process is dynamic in the sense that drying rate is not necessarily directly related to a given air temperature or a given air flow rate. Rather, either the air temperature may be decreased or air flow decreased to give a lower drying rate than if temperature alone is decreased. Conversely, drying rate might be increased by either increasing air flow and/or increasing air temperature. Step 144 (see FIG. 16) does not necessarily mean no adjustments occur in slide gates 70 or louvers 58 even if drying is proceeding without a call for a temperature or air flow rate change.

It will be appreciated that the present invention can take many forms and embodiments. The true essence and spirit of this invention are defined in the appended claims and it is not intended that the embodiment of the invention presented herein should limit the scope thereof. Variations obvious to one skilled in the art will be included within the invention defined by the claims.

For example, the materials for constructing the apparatus can vary according to need and desire. Many of the components have been made with metal sheet although some could be made with plastics.

The size of the air flow channels and the components can vary according to desire and need. In the preferred embodiment, the sizes were selected for specific reasons. For example, size of the docking stations, plenum assembly, mixing chambers, and other components is such that they can be disassembled and transported on standard over-the-road trucks. Also, the size allows standard lift or fork trucks to move the components, as opposed to requiring a crane. Also, the sizing and shapes were designed to facilitate desirable air movement through the product being dried. For example, the size of air outlet 38 of docking station 30 was correlated to the opening through louver assembly 28 and openings 22 and 24 in plenum assembly 12.

Exemplary dimensions are set forth below. It is to be understood that these dimensions can vary and some are approximations. The dimensions can vary relative to one another. The preferred embodiment is optimized for the type and size of bin 40 described herein. Dimensions could be proportionally scaled up or down for different sized bins or different drying requirements.

Plenum assembly 12 sections (one shown in FIG. 1)—approx. 7' long×84" tall×32" wide (can have a plurality of sections (e.g. ten) with a plurality of mixing chambers 20 (e.g. two) extending from each section of 12, thereby allowing many individual drying stations (e.g. two times 10 equals 20 drying stations)).

Hot air plenum 16—36" tall.

Cold air plenum 18—48" tall.

Openings 20 and 22—18" tall×65" long.

Slide gate frame—41" tall×65½" long.

Slide gate 70—12 GA HRS 23½"×66¾".

Mixing chamgber 20—68" tall×70" wide at end attached to plenum assembly 12; 28¼" deep; 24"×24" at louver end.

Louver frame—24"×24".

Conduit between louvers and docking station, including flexible coupling 34—approx. 24"×24"×18" long.

Docking station 30—overall approx. 64" long×44" wide×25¾" tall; inlet opening from louvers 24"×24"; outlet opening 38 from docking station approx. 46"×24".

Bin 40—approximately 60"×60" outside dimensions×60" tall; bottom opening 60"×48".

The preferred embodiment has been discussed regarding ear corn. Other products are possible. Examples are sunflower seeds (both on and off head), canola seed, soybeans, and other agricultural products. Further examples could be non-agricultural.

It is to be further understood that a significant advantage of dryer 10 is the ability to have multiple drying stations and that each station can be independently controlled. For example, one bin 40 could contain ear corn. Another bin could contain sunflower seeds. Computer 74 would be preprogrammed to know which type of material is in each bin, its initial moisture, and its initial weight. Desired drying rates could then be preprogrammed and controlled according to the present invention. Thus, despite the fact that relatively small bins are to be processed, dryer 10 can intelligently accommodate and automate the drying process to produce the highest quality dried material.

It is to be further understood that the ability for precise control of the drying process does not require high velocity air flows. Therefore, an object of the invention is to reduce air flow throughout the system. Reduction of air velocity can also minimize energy loss. Therefore, the invention does have specific relationships between the size of openings and the construction of the air pathways to reduce air velocity throughout the system and minimize energy loss. As previously discussed, the relationship between size of air paths, openings and transitions between sections of the dryer and even the nature of the air path (e.g. curved surfaces, proportionality between openings in different components relative to the bins 40), contribute to this end. Friction and inertial transitions have been designed to allow air to move slower so that change in direction does not give up as much energy as other some other configurations.

An example of the use of the present invention relates to ear corn in bins that hold in the range of 30 bushels. Six hundred feet cubed per minute of air flow is possible with dryer 10 for 30 bushels of ear corn. If the bins held 50 bushels, the system would need on the order of 1,000 feet cubed per minute air. Dryer 10 can accomodate the same. The general rule is approximately 20 cubic feet per minute per bushel of ear corn. This relationship can differ for other materials.

In the present embodiment, a more than adequate amount of air flow has been determined to be 20 feet cubed per minute. The size of bin 40 is tailored to the typical yields of around 30 bushels of ear corn. The quantity 20 feet cubed pre minute multiplied by 30 bushels equals 600 cubic feet per minute (cfm) as the general needed air flow capacity. As can be appreciated, this relationship can be varied and adjusted for different sizes of bins and different circumstances.

The PLC 72 can control fan speed, burner temperature, slide gate 70, louvers 58, as well as obtain data acquisition from scales 50, thermocouples 87, and pressure transducers 88.

The data acquisition can be accomplished and stored in a number of different ways. Commercially available components exist for the same. Commercially available software (e.g. from Jacobson-Holz Corporation of Perry, Iowa) could be easily modified for use with the present invention for coordinating data acquisition and data storage in a database, along with reporting capabilities.

It is to be understood that the relationship between slide gate 70 and louvers 58 has a subtle aspect. In the preferred embodiment, slide gate 70 can completely shut off air from plenum 16 or plenum 18, but not both, and it can not completely shut both at the same time or completely open both at the same time. This greatly simplifies the design and cost and works adequately to allow mixing of warmer and cooler air, if needed. However, louvers 58 can be completely closed to stop air flow into bin 40. They can also be almost completely closed to reduce air velocity to any desired level. Thus, the combination of gate 70 and louvers 58 provide all the flexibility needed to control air flow. Louvers 58 allow the dryer to control resistance to air flow so that it can dry one ear of corn, to one layer of ear corn, to multiple layers of ear corn, to full bins of ear corn.

A rubber gasket or mat could be fixed or placed on surfaces 36 of docking station 30 to decrease any air leaks during drying. Other similar gaskets or methods can be used at other locations in dryer 10 to reduce air leaks.

Another option would be to have two blowers for each plenum 16 and 18, one at each end of plenum directing air inwardly from each end. This may allow better air flow through the bins because the air flow from plenums 16 and 118 into the mixing plenum 20 will be influenced more by static pressure than velocity pressure.

A further option would be to have multiple docking stations connected to one mixing chamber. A set of independently controllable air flow control louvers could be used with each docking station.

Still further, docking station could be positioned in any of a variety of positions relative to the main plenum assembly 12. It could even be placed above or on top of assembly 12, with a mixing chamber in-between. Also, plenums 16 and 18 could be side by side instead of one over the other. Plenums 16 and 18 could be separate ducts instead of separate areas in one main plenum assembly.

Also, it is to be understood that the structure to control air flow through docking stations 30 and bins 40 can take on different configurations. As described above, slide gate 70 is used to meter air into mixing chamber 20, while louvers 58 meter air from mixing chamber 20 to docking station 30. Slide gate 70, as described above, can not completely shut off air flow. It can completely shut off air flow from plenum 16 or plenum 18, but not both. Louvers 58 can do so however. Therefore, in the described embodiment, the interplay between slide gate 70 and louvers 58 gives complete control over air flow through bins 40. To do this, the ability to completely shutoff air flow is needed.

It may be possible to eliminate louvers 58 if slide gate 70 were configured to comprise two independently controllable slide gates which can move between completely closing and completely opening the pathways to plenums 16 and 18. Other ways and structures are possible to meter or control air flow or air pressure.

Another alternative is to vary the placement of louvers 58. In the drawings louvers 58 are shown between mixing chamber 20 and docking station 30. They could also be positioned downstream therefrom. For example they could be positioned in docking station 30 across opening 38. They might even be positionable over the top of bin 40 or in the exhaust path from dryer 10. They would function to control the air pressure in bin 40 in any of those locations.

Docking station 30 is basically a housing with a flat receiving surface for bin 40. It can take many forms and configurations. It could basically be a location upon which a bin 40 can be placed. It does not necessarily require any retaining structure.

As can be seen, dryer 10 allows for a plurality of drying stations for individual bins, with the temperature and air pressure at each bin independently controllable. The operator simply has to monitor a graphic user interface (GUI) that supplies continuous information about the drying process for each bin 40. If drying is proceeding according to the operator's desire, no changes are made. If certain bins need adjustment, the operator can do so through the GUI.

Pressure transducer 88 can be any device or method to measure air velocity of air pressure, or from which those measures can be obtained.

The term "small lot", with regard to the present invention generally, is not necessarily limited to product of uniform characteristics in the same bin.

What is claimed is:

1. A method of batch drying small lots of a product comprising:

directing air flow through a small lot batch of product;

sensing drying rate comprising weighing said small lot batch of product from time to time; and independently adjusting temperature and rate of air flow through said small lot batch of product based on the weighing to control drying rate.

2. The method of claim 1 wherein said small lot batch of product comprises up to approximately 50 bushels.

3. The method of claim 1 wherein said product comprises agricultural product.

4. The method of claim 3 wherein said agricultural product comprises an agricultural crop.

5. The method of claim 4 wherein said agricultural crop comprises ear corn.

6. The method of claim 1 wherein the step of weighing the product comprises weighing the product in any container holding the product and subtracting weight of the container from total weight to derive weight of the product.

7. The method of claim 1 further comprising communicating weight of the product to a controlling device.

8. The method of claim 1 further comprising obtaining transductions by sensing air temperature and air pressur or velocity at or near the product and communicating said transductions to a controlling device.

9. The method of claim 8 further comprising communicating weight of the product and temperature and air pressure or velocity through the product to a controlling device and programming the controlling device to adjust temperature and rate of air flow based on said communicating.

10. The method of claim 1 further comprising substantially mechanically isolating the weighing of the product.

11. The method of claim 1 further comprising directing air flow through a plurality of small lot batches of product;

sensing drying rate comprising weighing each small lot batch of product from time to time; and independently adjusting temperature and rate of the air flow through each said small lot batch of product based on the weighing to independently control drying rate for each small lot batch of product.

12. The method of claim 11 wherein said product comprises agricultural product.

13. The method of claim 12 wherein said agricultural product comprises an agricultural crop.

14. The method of claim 13 wherein said agricultural crop comprises ear corn.

15. A method of drying a small lot batch of a product comprising:

deriving drying rate of the product related to drying rate;

feeding back the transductions to control temperature and air flow through the small lot batch of product.

16. The method of claim 15 further comprising a plurality of small lot batches of product, deriving drying rate and feeding back said transductions for drying rate for each batch to independently control temperature and air flow through each batch.

17. The method of claim 15 wherein said product comprises agricultural product.

18. The method of claim 17 wherein said agricultural product comprises an agricultural crop.

19. The method of claim 18 wherein said agricultural crop comprises ear corn.

20. The method of claim 15 wherein said transducing step comprises weighing the small lot batch of product.

* * * * *

UNITED STATES PATENT AND TRADEMARK OFFICE

CERTIFICATE OF CORRECTION

PATENT NO. : 6,230,419 B1
DATED : May 15, 2001
INVENTOR(S) : James L. Hunter and Charles G. McBee It is certified that error appears in the above-identified patent and that said Letters Patent is hereby corrected as shown below:

Title page,
Correct the inventor name James L. "Hinter" to James L. -- Hunter --.

Column 13,
Line 10, delete "pressur" and insert -- pressure --.

Column 14,
Line 9, after "produc" insert -- by periodically transducing a characteristic of the product --.

Signed and Sealed this

Nineteenth Day of March, 2002

*Attest:*

*Attesting Officer*

JAMES E. ROGAN
*Director of the United States Patent and Trademark Office*